US005625346A

United States Patent [19]

Shim et al.

[11] Patent Number: 5,625,346

[45] Date of Patent: Apr. 29, 1997

[54] ENHANCED CAPABILITIES OF SMOKE DETECTORS

[75] Inventors: Hyo Shim, Cerritos; Sham S. Hariram, Laguna Hills; Wai-Pak Wong, Cerritos; Ronald Blumke, Covina; Stanley C. Yu, Pico Rivera, all of Calif.

[73] Assignee: McDonnell Douglas Corporation, St. Louis, Mo.

[21] Appl. No.: 649,426

[22] Filed: May 16, 1996

Related U.S. Application Data

[63] Continuation of Ser. No. 325,129, Oct. 20, 1994, abandoned.

[51] Int. Cl.[6] ..... G08B 17/10

[52] U.S. Cl. ..... 340/628; 340/606; 340/627; 340/632; 340/514; 340/516

[58] Field of Search ..... 340/628, 629, 340/630, 606, 632, 633, 634, 514, 515, 516, 627

[56] References Cited

U.S. PATENT DOCUMENTS

| | | | |
|---|---|---|---|
| 3,876,999 | 4/1975 | Lee | 340/606 |
| 4,305,069 | 12/1981 | Machen et al. | 340/628 |
| 4,617,560 | 10/1986 | Gutmann | 340/628 |
| 4,764,758 | 8/1988 | Skala | 340/627 |
| 5,103,212 | 4/1992 | Notarianni et al. | 340/628 |
| 5,182,542 | 1/1993 | Adelman et al. | 340/521 |
| 5,231,378 | 7/1993 | Dennis et al. | 340/630 |

*Primary Examiner*—Jeffery Hofsass
*Assistant Examiner*—Benjamin C. Lee
*Attorney, Agent, or Firm*—Timothy H. Courson, Esq.; J. Rick Tache, Esq.

[57] ABSTRACT

A smoke detector unit with a fan that creates an airstream which flows through a smoke detector. Both the fan and the smoke detector are located within a housing that is mounted to the fuselage of an airplane. The smoke detector generates an output signal that is provided to an indicator when a threshold level of smoke is detected. The output signal is typically latched by a relay that is also located within the housing.

6 Claims, 1 Drawing Sheet

ENHANCED CAPABILITIES OF SMOKE DETECTORS

This is a continuation application of application Ser. No. 08/325,129, filed Oct. 20, 1994, now abandoned.

BACKGROUND OF THE INVENTION

1. Field of the Invention

The present invention relates to a smoke detection system for an aircraft.

2. Description of Related Art

Large commercial aircraft typically contain smoke detectors which detect smoke and provide an indication that a fire may exist within the vehicle. The smoke detector is typically mounted to the fuselage above the ceiling of the passenger compartment. Aircraft specifications require smoke detection much sooner than detection within a building structure. To decrease the detection time interval, a duct is installed into the aircraft to channel a stream of air from the passenger compartment to the detector. The duct is typically coupled to the airplane vent system which provides a flow of air into the smoke detector.

The smoke detector duct adds weight to the vehicle, thereby reducing the fuel efficiency of the airplane. The detector duct also requires additional material and labor to install, thereby increasing the cost of producing the aircraft. It would therefore be desirable to provide a smoke detection system for an aircraft which did not require additional ducts to couple the detector to the passenger compartment of the plane.

SUMMARY OF THE INVENTION

The present invention is a smoke detector unit with a fan that creates an airstream which flows through a smoke detector. Both the fan and the smoke detector are located within a housing that is mounted to the fuselage of an airplane. The smoke detector generates an output signal that is provided to an indicator when a threshold level of smoke is detected. The output signal is typically latched by a relay that is also located within the housing.

BRIEF DESCRIPTION OF THE DRAWINGS

The objects and advantages of the present invention will become more readily apparent to those ordinarily skilled in the art after reviewing the following detailed description and accompanying drawings, wherein.

DETAILED DESCRIPTION OF THE INVENTION

Figure 1:
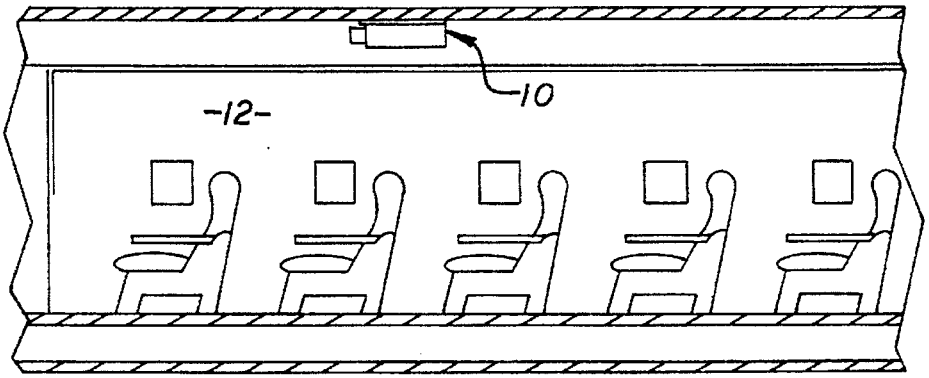
FIG. 1 is a side view of a smoke detector unit located above the passenger compartment ceiling of an aircraft.

Referring to the drawings more particularly by reference numbers, FIG. 1 shows a smoke detector unit 10 of the present invention. The smoke detector 10 is typically mounted to the fuselage 12 of a commercial aircraft. Although the detector 10 is shown and described mounted to an aircraft, it is to be understood that the detector unit 10 of the present invention can be attached to other structures such as a residential or commercial building.

Figure 2:
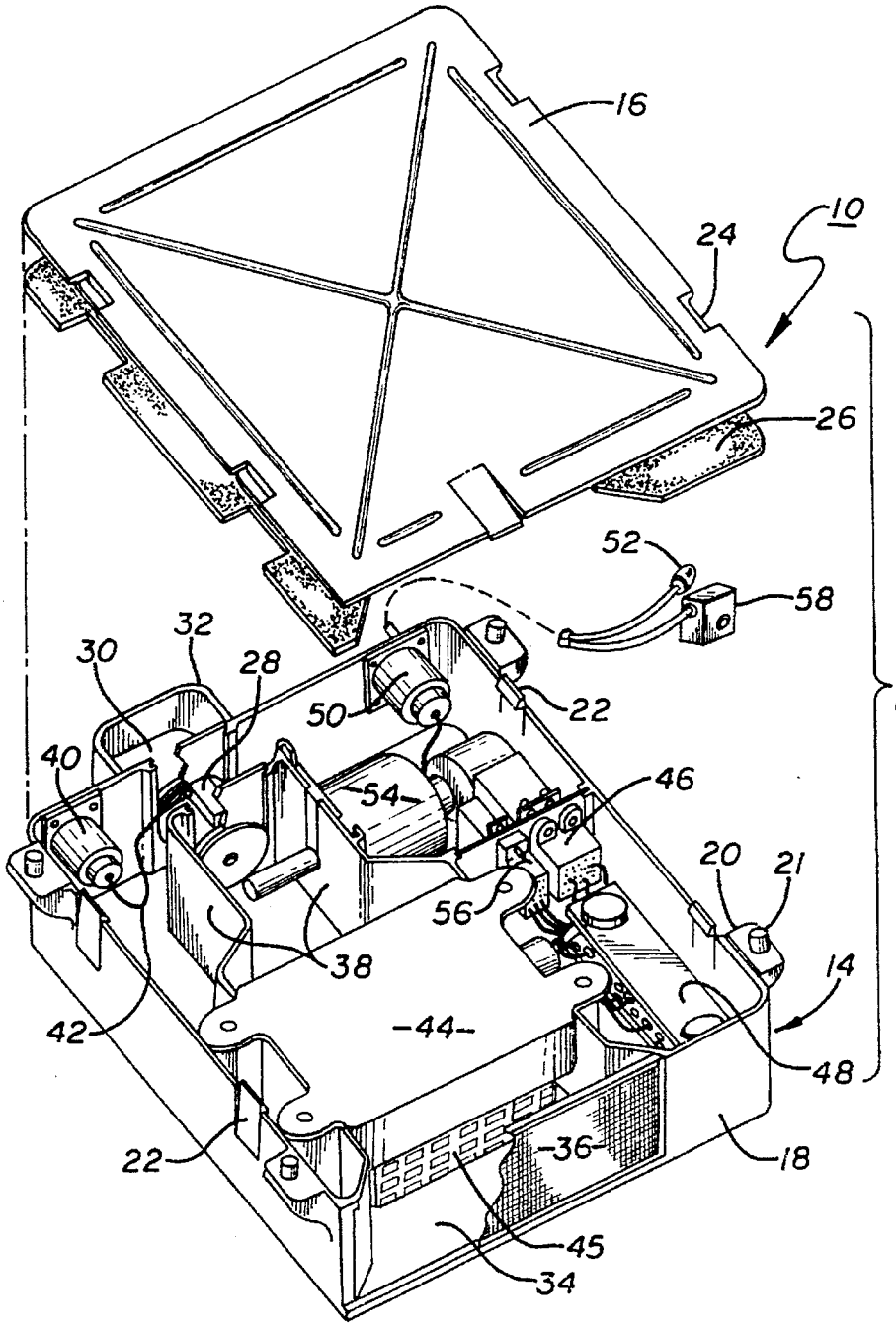
FIG. 2 is a perspective view showing the components of the smoke detector.

As shown in FIG. 2, the detector unit 10 includes a housing 14. The housing 14 may be assembled from a cover 16 that is attached to a base member 18. The base member

18 may have a plurality of ears 20 with studs 21 that are pressed into corresponding holes (not shown) in the fuselage frame 12. The base member 18 may also have a number of latches 22 that snap into corresponding grooves 24 in the cover plate 16 to attach the cover 16 to the base 18. The latches 22 can be deflected to open the cover 16 and provide access to the inside of the unit 10. The underside of the cover 16 may have a gasket 26 to seal the edges of the housing 14.

Within the unit 10 is a fan 28 that creates a flow of air through the housing 14. In the preferred embodiment, the fan 28 creates an airflow ranging between 14–17 cubic feet per minute (CFM). The fan 28 is located within an opening 30 in the housing 14. The opening 30 may have a duct 32 to lead the air from the fan 28. The fan 28 typically pulls air through an opening 34 located at the opposite end of the housing 14. Although the fan 28 is described as pulling air from opening 34 to opening 30, it is to be understood that the fan 28 can pull air from opening 30 to opening 34. The opening 34 may have a filter 36 that filters out non-smoke impurities from the airstream. The filtered impurities may be substances that provide a false detection of smoke. The inner cavity of the housing 14 may also have a pair of walls 38 that provide a duct that guides the flow of air through the housing 14. The fan 28 is connected to an external source of electrical power through connector 40 and wires 42.

Located between the walls 38 of the housing 14 is a smoke detector 44 which detects the presence of smoke in the air that flows through the unit 10. The smoke detector 44 may have a photoelectric sensor which provides an output signal when the content of smoke exceeds a predetermined threshold level. The smoke detector 44 contains an inner passage 45 that allows the air to flow through the detector 44 from the opening 34 to the fan 28.

The smoke detector 44 is coupled to a first latching relay 46 by an electrical terminal board 48. The terminal board 48 is coupled to the external structure by connector 50. The first relay 46 is typically connected to an indicator light 52 and/or an indicator readout located in the cockpit of the aircraft. When the smoke detector 44 detects an excessive amount of smoke in the airstream, the detector 44 provides an output signal which actuates the relay 46 and provides an indication that smoke has been detected. The relay 46 is latching so that the indicator light 52 remains on even when the content of smoke falls below the threshold level. In the preferred embodiment, the first relay 46 is a 22 second latching relay device.

Located between the fan 28 and the smoke detector 44 is a flow sensor 54 which senses the presence of airflow through the housing 14. The flow sensor 54 is connected to the external indicator light 52. The unit also has a second relay 56 that is coupled to the first relay 46 and an external button 58, typically located in the cockpit of the aircraft. The second relay 56 de-activates the first relay 46.

Depressing the external button 58 provides power to the flow sensor 54 and the smoke detector 44. The flow sensor 54 operates as a switch between the external button 58 and the smoke detector 44. If there is an adequate flow of air through the housing 14, the flow sensor 54 switch is closed and power is provided to the smoke detector 44. Power to the smoke detector 44 will initiate a self-diagnostic test within the detector 44. If the smoke detector 44 is functioning properly, an output signal is provided to the indicator light 52 to provide an indication that the unit is operating properly. The second relay 54 de-activates the first relay 46 so that the output of the smoke detector 44 is not latched when the external button is depressed.

In operation, the fan 28 creates a flow of air that passes through the smoke detector 44. If a threshold level of smoke is detected, the detector 44 will switch the relay 46 to provide an indication in the cockpit of the existence of smoke. To test the system, the pilot can depress the external button to insure that the detector is operating properly and that there is a sufficient flow of air through the detector 44. Pulling the air through the smoke detector has been found to reduce the time required to detect smoke.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A smoke detection unit, comprising:

a housing;

a fan that is located within said housing, said fan creates a flow of air through said housing;

a smoke detector that is located within said housing and which detects smoke in the flow of air created by said fan;

a flow sensor, when activated, senses the flow of air and activates said smoke detector to initiate a self-diagnostic test when the flow of air exceeds a threshold level;

a test button that is operatively connected to said smoke detector through said flow sensor for selectively activating said flow sensor to activate said smoke detector to initiate said self-diagnostic test when the test button is depressed; and, an indicator light that is illuminated when said button is depressed, said flow sensor senses that the flow of air exceeded said threshold level, and said smoke detector passes said self-diagnostic test.

2. The unit as recited in claim 1, wherein said indicator light is coupled to said smoke detector by a latch.

3. A smoke detection unit, comprising:

a housing;

fan means for creating a flow of air through said housing, said fan means being located within said housing;

smoke detector means for detecting smoke in the flow of air created by said fan means, said smoke detector means being located within said housing;

flow sensor means, when activated, for sensing the flow of air and activating said smoke detector means to initiate a self-diagnostic test when the flow of air exceeds a threshold level;

a test button that is operatively connected to said smoke detector means through said flow sensor means for selectively activating said flow sensor means to activate said smoke detector means to initiate said self-diagnostic test when the test button is depressed; and, an indicator light that is illuminated when said button is depressed, said flow sensor means senses that the flow of air exceeded said threshold level, and said smoke detector means passes said self-diagnostic test.

4. The unit as recited in claim 3, further comprising latching means for coupling said indicator light to said smoke detector.

5. A smoke detection system for an aircraft, comprising:

a housing attached to an aircraft ceiling;

a fan that is located within said housing, said fan creates a flow of air through said housing;

a smoke detector that is located within said housing and which detects smoke in the flow of air created by said fan;

a flow sensor, when activated, senses the flow of air and activates said smoke detector to initiate a self-diagnostic test when the flow of air exceeds a threshold level;

a test button that is operatively connected to said smoke detector through said flow sensor for selectively activating said flow sensor to activate said smoke detector to initiate said self-diagnostic test when the test button is depressed; and, an indicator light that is illuminated when said button is depressed, said flow sensor senses that the flow of air exceeded said threshold level, and said smoke detector passes said self-diagnostic test.

6. The system as recited in claim 5, wherein said indicator light is coupled to said smoke detector by a latch.

* * * * *